US005503576A

United States Patent [19]

Ming et al.

[11] Patent Number: 5,503,576

[45] Date of Patent: Apr. 2, 1996

[54] VIBRATION ISOLATION MEANS FOR OUTBOARD MOTOR

[75] Inventors: Lam H. Ming, Tsing Yi Island; Chu K. Ying, Yuen Long, both of Hong Kong

[73] Assignee: Outboard Marine Corporation, Waukegan, Ill.

[21] Appl. No.: 175,260

[22] Filed: Dec. 29, 1993

[51] Int. Cl.[6] ..... B63H 1/15

[52] U.S. Cl. ..... 440/52

[58] Field of Search ..... 440/49, 50, 51, 440/52, 53

[56] References Cited

U.S. PATENT DOCUMENTS

| | | | |
|---|---|---|---|
| 1,999,694 | 4/1935 | Irgens | 115/18 |
| 2,642,829 | 6/1953 | Kiekhaefer | 115/18 |
| 2,740,368 | 4/1956 | Irgens et al. | 115/18 |
| 2,909,031 | 10/1959 | Kiekhaefer | 60/31 |
| 2,911,936 | 11/1959 | Kiekhaefer | 115/70 |
| 2,916,007 | 12/1959 | Kiekhaefer | 115/18 |
| 3,002,489 | 10/1961 | Watkins | 115/18 |
| 3,127,866 | 4/1964 | Mohr | 115/17 |
| 3,358,668 | 12/1967 | Post et al. | 123/198 |
| 3,599,594 | 8/1971 | Taipale | 115/17 |
| 3,613,631 | 10/1971 | Wick | 115/17 |
| 3,750,615 | 4/1973 | Haft et al. | 115/18 |
| 3,782,321 | 1/1974 | Ellingsen | 115/17 |
| 3,934,537 | 1/1976 | Hall | 115/17 |
| 4,303,401 | 12/1981 | Sanmi et al. | 440/88 |
| 4,507,090 | 3/1985 | Kobayashi et al. | 440/52 |
| 4,615,683 | 10/1986 | Harada et al. | 440/52 |
| 4,666,410 | 5/1987 | Anselm | 440/61 |
| 4,714,132 | 12/1987 | Hattorie et al. | 180/312 |
| 4,966,567 | 10/1990 | Breckenfeld et al. | 440/89 |
| 4,979,918 | 12/1990 | Breckenfeld et al. | 440/52 |
| 5,037,340 | 8/1991 | Shibata | 440/88 |
| 5,083,949 | 1/1992 | Breckenfeld et al. | 440/52 |
| 5,100,351 | 3/1992 | Shibata | 440/89 |
| 5,180,319 | 1/1993 | Shiomi et al. | 440/52 |
| 5,192,235 | 3/1993 | Dunham et al. | 440/52 |
| 5,219,306 | 6/1993 | Takahashi | 440/52 |
| 5,295,879 | 3/1994 | Meier et al. | 440/52 |

FOREIGN PATENT DOCUMENTS

| | | |
|---|---|---|
| 56-35500 | 4/1981 | Japan . |
| 56-54697 | 5/1981 | Japan . |
| 58-192199 | 12/1983 | Japan . |
| 59-230898 | 12/1984 | Japan . |
| 59-230896 | 12/1984 | Japan . |
| 60-144813 | 7/1985 | Japan . |
| 60-128094 | 7/1985 | Japan . |
| 60-128093 | 7/1985 | Japan . |
| 63-100399 | 6/1988 | Japan . |
| 63-28720 | 8/1988 | Japan . |
| 2-38437 | 8/1990 | Japan . |

*Primary Examiner*—Stephen Avila
*Attorney, Agent, or Firm*—Michael, Best & Friedrich

[57] ABSTRACT

Disclosed herein is an outboard motor comprising means adapted for connection to a boat transom and including a swivel bracket having a kingpin bore, a propulsion unit comprising a power head including an internal combustion engine, a lower unit fixed to the power head and including a drive shaft having a vertically extending axis, being driven by the engine, and adapted to drive a propeller, a forwardly facing surface located on the propulsion unit in forwardly spaced relation to the drive shaft axis, a kingpin extending in the kingpin bore and including an upper end, a steering arm connected to the upper end of the kingpin for rotation in common with the kingpin, and vibration isolation means connecting the steering arm and the propulsion unit and located above the upper end of the kingpin and forwardly of the forwardly facing surface on the propulsion unit.

20 Claims, 2 Drawing Sheets

VIBRATION ISOLATION MEANS FOR OUTBOARD MOTOR

BACKGROUND OF THE INVENTION

The invention relates generally to marine propulsion devices and, more particularly, to outboard motors including a steerable and tiltable propulsion unit which includes a power head and which supports a propeller shaft driven by the power head.

Still more particularly, the invention also relates to means for vibrationally isolating the propulsion unit from a boat hull and to vibration isolating means extending between the propulsion unit and a kingpin/steering arm assembly rotatable in a tiltable swivel bracket.

In prior 9.9 and 15 horsepower outboard motors, a pair of vibration isolating assemblies similar to the vibration isolating assemblies 71 and 73 described hereinafter, were located inside a drive shaft housing and were fixed thereto by suitable bolts extending between the drive shaft housing and the exterior metallic member of the vibration isolating assemblies.

In addition, the previous outboard motor included a thrust block which was similar to the thrust block 141 described hereinafter, which was located in the drive shaft housing, and which was engagable between walls formed in recesses in the metallic outer member of the vibration isolation assemblies and a bridge member fixedly extending from the inside metallic member of the vibration isolation assemblies.

As in many past constructions, the location of the vibration isolating assemblies and thrust block within the drive shaft housing undesirably exposed the vibration isolating assemblies and the thrust block to hot exhaust gases.

Attention is also directed to the following U.S. Pat. Nos.:

| | | |
|---|---|---|
| 1,999,694 | Irgens | September 14, 1933 |
| 2,642,829 | Kiekhaefer | June 23, 1953 |
| 2,740,368 | Irgens, et al. | April 1956 |
| 2,909,031 | Kiekhaefer | October 20, 1959 |
| 2,911,936 | Kiekhaefer | November 1959 |
| 2,916,007 | Kiekhaefer | December 1959 |
| 3,002,489 | Watkins | April 1964 |
| 3,127,866 | Mohr | April 1964 |
| 3,358,668 | Post, et al. | December 1967 |
| 3,599,594 | Taipale | August 1971 |
| 3,613,631 | Wick | October 19, 1971 |
| 3,750,615 | Haft, et al. | August 1973 |
| 3,782,321 | Ellingsen | January 1974 |
| 3,934,537 | Hall | January 1976 |
| 4,303,401 | Sanmi, et al. | December 1, 1981 |
| 4,507,090 | Kobayashi, et al. | March 26, 1985 |
| 4,615,683 | Harada, et al. | October 7, 1986 |
| 4,666,410 | Anselm | May 19, 1987 |
| 4,714,132 | Hattorie, et al. | December 1987 |
| 4,966,567 | Breckenfeld, et al. | October 30, 1990 |
| 4,979,918 | Breckenfeld, et al. | December 25, 1990 |
| 5,037,340 | Shibata | August 6, 1991 |
| 5,100,351 | Shibata | March 31, 1992 |
| 5,180,319 | Shiomi | January 19, 1993 |

Attention is also directed to the following Japanese applications:

| | | |
|---|---|---|
| 2-38437 | 58-192199 | 60-128094 |
| 56-35500 | 59-230896 | 60-144813 |
| 56-54697 | 59-230898 | 63-100399 |
| 63-28720 | 60-128093 | |

Attention is also direct to U.S. application Ser. No. 782,545, filed Oct. 25, 1991, and U.S. application Ser. No. 665,014 filed Mar. 5, 1991.

SUMMARY OF THE INVENTION

The invention provides an outboard motor comprising means adapted for connection to a boat transom and including a swivel bracket having a kingpin bore, a propulsion unit comprising a power head including an internal combustion engine, and a lower unit fixed to the power head and including a shaft driven by the engine and adapted to support a propeller, a kingpin extending in the kingpin bore, a steering arm connected to the kingpin for rotation in common with the kingpin, which steering arm includes a bore extending in the fore and aft direction, a resilient element extending in the bore and including a fore and aft bore, and a bolt extending through the bore in the resilient element and fixedly connected to the propulsion unit.

The invention also provides an outboard motor comprising means adapted for connection to a boat transom and including a swivel bracket having a kingpin bore, a propulsion unit comprising a power head including an internal combustion engine, and a lower unit fixed to the power head and including a shaft driven by the engine and adapted to support a propeller, a kingpin extending in the kingpin bore and having an upper end, a steering arm connected to the upper end of the kingpin for rotation in common with the kingpin, and vibration isolation means connecting the steering arm and the propulsion unit and located above the upper end of the kingpin.

The invention also provides an outboard motor comprising means adapted for connection to a boat transom and including a swivel bracket having a kingpin bore, a propulsion unit comprising a power head including an internal combustion engine, a lower unit fixed to the power head and including a drive shaft having a vertically extending axis, being driven by the engine, and adapted to drive a propeller, a forwardly facing surface located on the propulsion unit in forwardly spaced relation to the drive shaft axis, a kingpin extending in the kingpin bore, and a steering arm connected to the kingpin for rotation in common with the kingpin, and vibration isolation means connecting the steering arm and the propulsion unit and located forwardly of the forwardly facing surface on the propulsion unit.

The invention also provides an outboard motor comprising means adapted for connection to a boat transom and including a swivel bracket having a kingpin bore, a propulsion unit comprising a power head including an internal combustion engine, a lower unit fixed to the power head and including a drive shaft having a vertically extending axis, being driven by the engine, and adapted to drive a propeller, a forwardly facing surface located on the propulsion unit in forwardly spaced relation to the drive shaft axis, a kingpin/steering arm assembly including a kingpin extending in the kingpin bore, and a steering arm connected to the kingpin for rotation in common with the kingpin, a thrust plate supported by the kingpin/steering arm assembly, and a thrust block which is fabricated of resilient material, which is supported by the kingpin/steering arm assembly, which has a rearward surface engaging the forwardly facing surface, and which has a forward surface engaging the thrust plate.

Other features of and advantages of the invention will become apparent to those skilled in the art upon review of the following detailed description, claims, and drawings.

IN THE DRAWINGS

Figure 3:
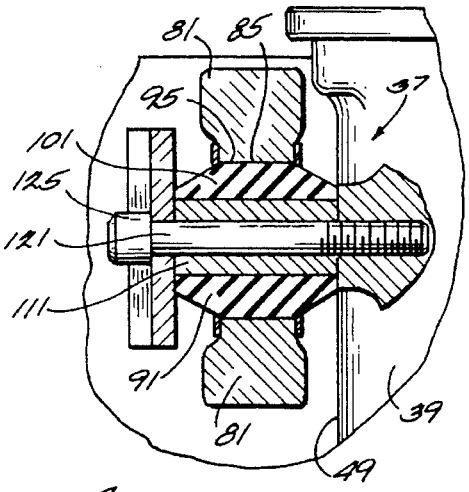
FIG. 3 is a fragmentary sectional view taken along line 3—3 of FIG. 2.
Figure 1:
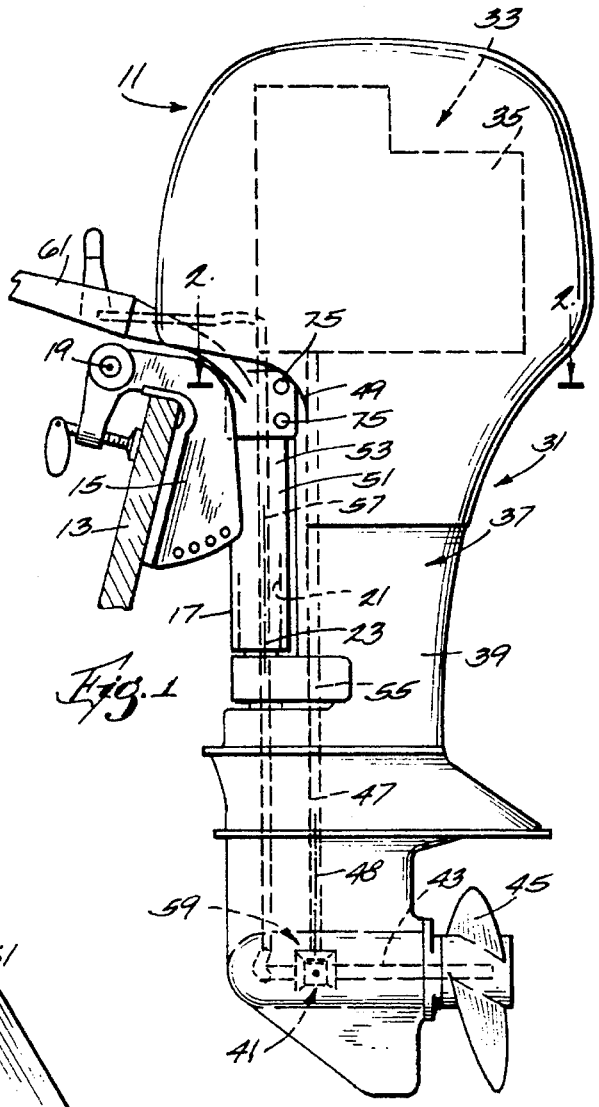
FIG. 1 is a side elevational view of an outboard motor incorporating various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is an outboard motor 11 including means for releasable attachment thereof to a boat transom 13. Such means comprises a transom bracket 15 adapted to be fixedly attached to the boat transom 13 and a swivel bracket 17 connected to the transom bracket 15 for vertical swinging movement about a tilt axis 19 which is horizontal when the transom bracket 15 is boat mounted. The swivel bracket 17 includes a kingpin bore 21 having an axis 23 which extends generally vertically when the transom bracket 15 is fixed to the boat transom 13 and when the swivel bracket 17 is in its normal operating position.

The outboard motor 11 also includes a propulsion unit 31 which includes a power head 33 comprising an internal combustion engine 35, together with a lower unit 37 including a drive shaft housing 39 having an upper end fixed to the power head 33 and a lower end. In addition, the propulsion unit 31 includes a gear case 41 which is fixed to the lower end of the drive shaft housing 39 and which rotatably supports a shaft 43 which is adapted to support and drive a propeller 45 and which is driven from the engine 35 by a drive shaft 47 extending in the drive shaft housing 39 and including an axis 48. The propulsion unit 31 also includes a forwardly facing face or surface 49 located forwardly of the drive shaft axis 48.

The outboard motor 11 further includes a kingpin 51 which extends through the swivel bracket kingpin bore 21 and which, at its lower end, is connected to the propulsion unit 31 by any suitable mounting means 55 providing vibration isolation.

Figure 5:
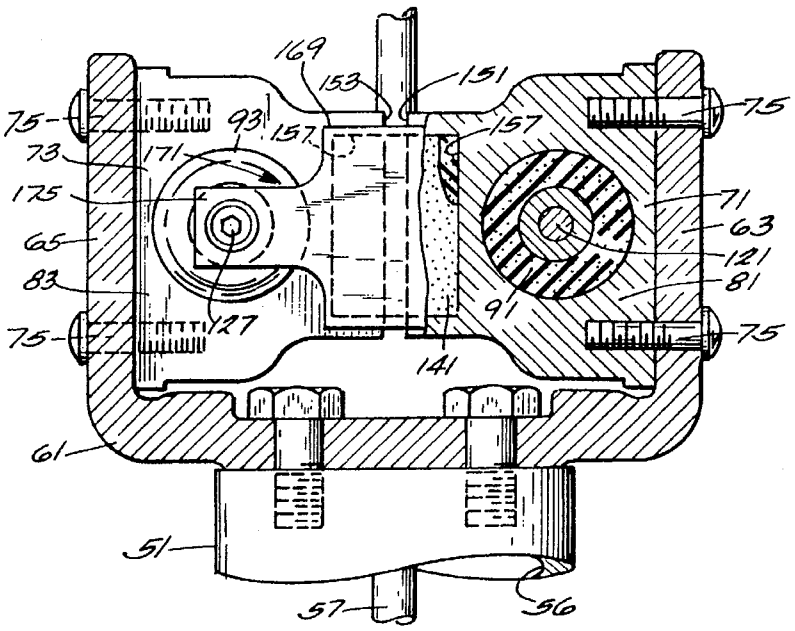
FIG. 5 is a partially broken away sectional view taken generally along line 5—5 of FIG. 4.
Figure 4:
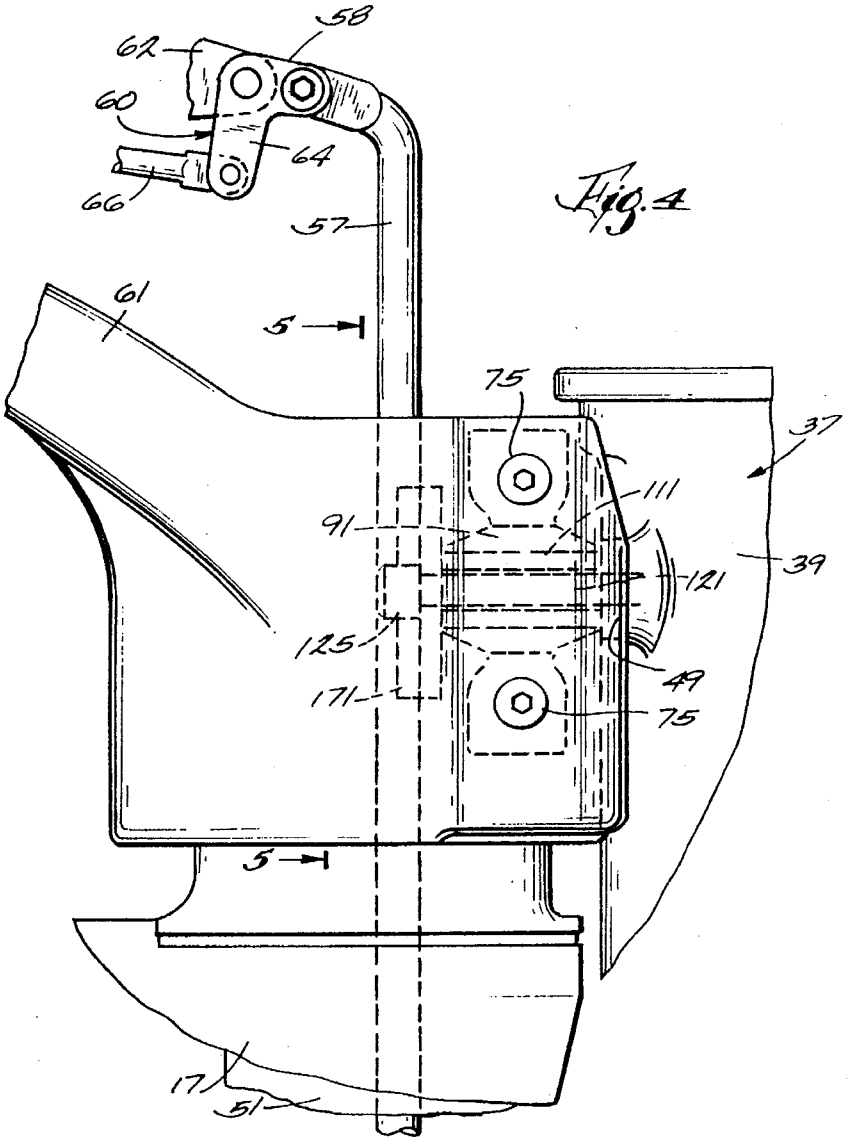
FIG. 4 is an enlarged fragmentary side elevational view of a portion of the outboard motor shown in FIG. 1.

At its upper end 53, the kingpin 51 is suitably fixedly connected to a steering arm 61 which is adapted to be manually, or hydraulically, or otherwise manipulated about the kingpin axis 23 to affect steering movement of the propulsion unit 31 relative to the swivel bracket 17. The kingpin 51 and the steering arm 61 comprise a kingpin/steering arm assembly. Preferably the kingpin/steering arm assembly is vertically apertured as shown at 56 in FIG. 5 to permit passage therethrough of an actuating linkage 57 connected to a transmission 59 connecting the shafts 43 and 47. As shown in FIG. 4, the upper end of the linkage rod 57 is pivotally connected to one arm 58 of a bell crank 60 which is pivotally mounted on a fragmentarily illustrated boss 62 extending from the crank case of the engine 35. The bell crank 60 also includes a second arm 64 which is pivotally connected to a lever 66 extending outwardly of the engine cowling to thereby enable actuation of the transmission 59 by vertical pivoting movement of the lever 66.

The outboard motor 11 also includes means mounting or connecting the upper end of the kingpin 51 to the propulsion unit 31 in such manner as to vibrationally isolate the kingpin 51 (and kingpin/steering arm assembly) from the propulsion unit 31.

As thus far described, the construction is conventional and any suitable arrangement can be employed.

In the disclosed construction, the means which connects the upper end of the kingpin 51 to the propulsion unit 31 and vibrationally isolates the propulsion unit 31 from the kingpin/steering arm assembly is located above the upper end 53 of the kingpin 51 and forwardly of the forwardly facing surface 49 of the propulsion unit 31. While other constructions can be employed, in the disclosed construction, the forwardly facing surface 49 is provided on the drive shaft housing 39 is located in forwardly spaced relation to the drive shaft axis 48.

More particularly, while other constructions can, of course, be employed, in the disclosed construction, the steering arm 61 includes first and second walls 63 and 65 which extend in spaced, facing relation to each other in the fore and aft direction and which respectively include inner facing surfaces 67 and 69. In addition, the connecting and isolating means includes first and second vibration isolating assemblies 71 and 73 which are respectively fixed to the inner surfaces 67 and 69 of the first and second walls 63 and 65 by any suitable means, such as the illustrated bolts 75.

More particularly, the first and second vibration isolating assemblies 71 and 73 include respective first and second outer members 81 and 83 which are fabricated of metal or other non-resilient material and which are respectively fixed to the adjacent walls 63 and 65 by the before mentioned bolts 75 and which include respective first and second bores 85 and 87 extending in the fore and aft direction. Respectively engaged in the first and second bores 85 and 7 and bonded thereto are respective resilient mounts 91 and 93 which are fabricated of rubber or rubber like material and which include respective outer generally cylindrical surfaces 95 and 97 which are engaged with and bonded to the inner surfaces of the bores 85 and 87, and inner cylindrical surfaces 101 and 103 respectively which are engaged with and bonded to the outer surfaces of first and second sleeve members 111 and 113 which are fabricated of metallic or other non-resilient material. Received in the hollow interior of the first and second sleeve members 111 and 113 are respective first and second bolts 121 and 123 which extend in the fore and aft direction, which, at their forward ends, include respective heads 125 and 127 and which, at their rearward ends, are respectively threaded into suitable laterally spaced first and second bores 131 and 133 in the forward face 49 of the drive shaft housing 39.

Figure 2:
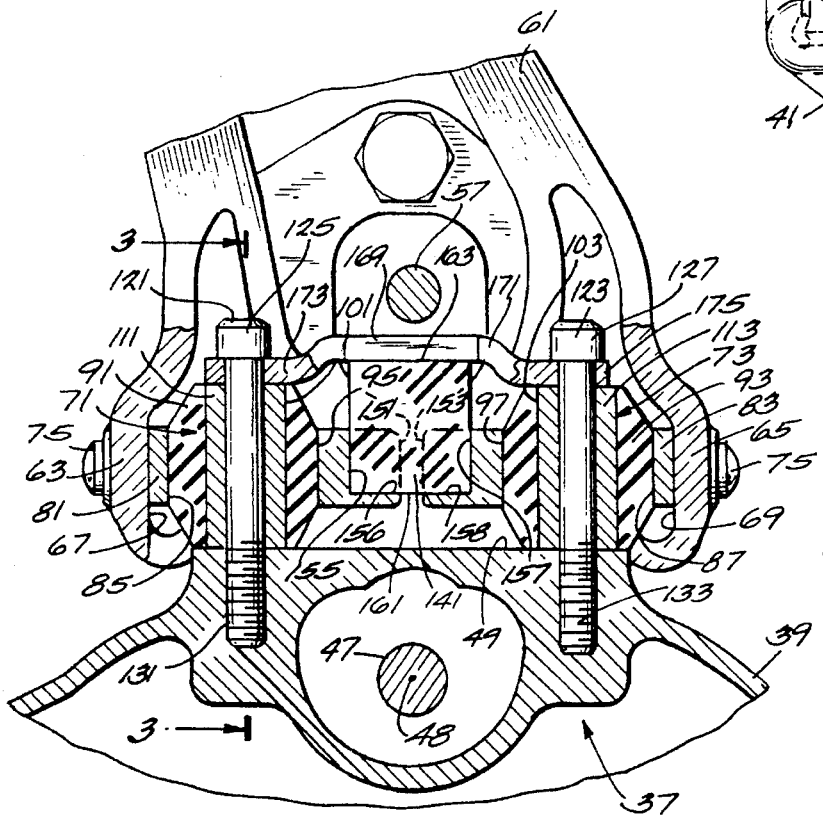
FIG. 2 is an enlarged fragmentary sectional view taken along line 2—2 of FIG. 1.

The connecting and isolating means also includes (see FIGS. 2 and 5) a thrust transmitting resilient block 141 which is fabricated of rubber or rubber like material, which is generally of square or rectangular configuration, and which is located forwardly of the forward face 49 of the drive shaft housing 39. The thrust block 141 is supported, at least in part, by the first and second outer metallic members 81 and 83 fixed to the steering arm 61. While other constructions can be employed, in the disclosed construction, the first and second members 81 and 93 respectively include (see FIG. 5) surfaces 151 and 153 which extend in spaced facing relation to each other in the fore and aft direction and which respectively include channel shaped recesses 155 and 157 which receive the opposite side portions of the thrust block 141, which extend in the fore and aft direction, and which include respective rearwardly located and forwardly facing wall surfaces 156 and 158 . The thrust block 141 also includes (see FIG. 2) a rearward surface 161 which engages the forwardly facing wall surfaces 156 and 158 of the metallic outer members 81 and 83, and a forward face 163 which engages a central portion 169 of a thrust plate or bridge 171 having opposed laterally extending wings 173 and 175 with respective bores through which the bolts 121 and 123 respectively pass and with the wings 173 and 175 respectively sandwiched between the bolt heads 125 and 127 and the sleeve members 111 and 113. Thus, in effect the thrust plate or bridge 171 is fixed to the forward ends of the sleeve members 111 and 113.

The thrust block 141 is thus confined between the outer metallic members 81 and 83, and between the central portion 169 of the thrust plate 171, and the forwardly facing wall surfaces 156 and 158 of the outer metallic members 81 and 83 for transmission of thrust from the propulsion unit 31 to the kingpin/steering arm assembly, and therefrom through the swivel bracket 17 and transom bracket 15 to the boat hull.

Various of the features of the invention are set forth in the following claims.

We claim:

1. An outboard motor comprising means adapted for connection to a boat transom and including a swivel bracket having a kingpin bore, a propulsion unit comprising a power head including an internal combustion engine, and a lower unit fixed to said power head and including a shaft driven by said engine and adapted to support a propeller, a steering assembly including a kingpin extending in said kingpin bore, a steering arm connected to said kingpin for rotation in common with said kingpin, and a cavity extending in the fore and aft direction, a resilient element extending in said cavity and including an aft end, an outer peripheral surface fixed to said steering assembly, and a fore and aft bore, and a bolt extending through said bore in said resilient element and fixedly connected to said propulsion unit so as to engage said aft end with said propulsion unit.

2. An outboard motor in accordance with claim 1 and further including a second resilient element supported between said propulsion unit and said steering assembly.

3. An outboard motor claim comprising means adapted for connection to a boat transom and including a swivel bracket having a kingpin bore, a propulsion unit comprising a power head including an internal combustion engine, and a lower unit fixed to said power head and including a shaft driven by said engine and adapted to support a propeller, a steering assembly including a kingpin extending in said kingpin bore and a steering arm connected to said kingpin for rotation in common with said kingpin, said steering assembly including a bore extending in the fore and aft direction, a resilient element extending in said bore and including a fore and aft bore, and a bolt extending through said bore in said resilient element and fixedly connected to said propulsion unit, a second resilient element supported between said propulsion unit and said steering assembly and including an aft surface in engagement with said propulsion unit and a forward surface in generally spaced parallel relation to said aft surface, and a thrust plate engaging said forward surface of said second resilient element and fixed to said bolt.

4. An outboard motor in accordance with claim 3 and further including a sleeve member which receives said bolt and engages said bore in said first mentioned resilient element.

5. An outboard motor comprising means adapted for connection to a boat transom and including a swivel bracket having a kingpin bore, a propulsion unit comprising a power head including an internal combustion engine, and a lower unit fixed to said power head and including a shaft driven by said engine and adapted to support a propeller, a kingpin extending in said kingpin bore and having an upper end, a steering arm connected to said upper end of said kingpin for rotation in common with said kingpin, and vibration isolation means connecting said steering arm and said propulsion unit, located above said upper end of said kingpin, and including a rubber mount having an aft end engaged with said propulsion unit, and an outer periphery extending forwardly from said aft end and engaged with said steering arm.

6. A marine propulsion device comprising means adapted for connection to a boat transom and including a swivel bracket having a kingpin bore, a propulsion unit comprising a power head including an internal combustion engine, and a lower unit fixed to said power head and including a shaft driven by said engine and adapted to support a propeller, a kingpin extending in said kingpin bore and having an upper end, a steering arm connected to said upper end of said kingpin for rotation in common with said kingpin and including first and second walls extending in spaced relation to each other in the fore and aft direction, and vibration isolation means connecting said steering arm and said propulsion unit, located above said upper end of said kingpin, and including first and second non-resilient members respectively fixedly connected to said first and second walls and including respective first and second bores extending in the fore and aft direction, first and second resilient elements extending respectively in said first and second bores and respectively including first and second fore and aft bores, and first and second bolts extending respectively through said first and second bores in said resilient elements and fixedly connected to said propulsion unit.

7. An outboard motor in accordance with claim 6 wherein said first and second members respectively include first and second surfaces extending in spaced facing relation to each other in the fore and aft direction and respectively including therein first and second recesses which extend in the fore and aft direction, and a third resilient element located partially in said recesses.

8. An outboard motor in accordance with claim 7 wherein said third resilient element includes an aft surface in engagement with said propulsion unit and a forward surface in generally spaced parallel relation to said aft surface, and further including a thrust plate engaging-said forward surface of said third resilient element and fixed to said first and second bolts.

9. An outboard motor in accordance with claim 8 wherein said thrust plate includes a central portion engaging said forward surface of said third resilient element and opposed first and second wing portions extending oppositely from said central portion and including respective first and second bores through which said first and second bolts extend.

10. An outboard motor in accordance with claim 9 and further including first and second sleeve members which respectively receive said bolts and engage said first and second bores in said first and second resilient elements.

11. An outboard motor comprising means adapted for connection to a boat transom and including a swivel bracket having a kingpin bore, a propulsion unit comprising a power head including an internal combustion engine, a lower unit fixed to said power head and including a drive shaft having a vertically extending axis, being driven by said engine, and adapted to drive a propeller, a forwardly facing surface located on said propulsion unit in forwardly spaced relation to said drive shaft axis, a kingpin extending in said kingpin bore, a steering arm connected to said kingpin for rotation in common with said kingpin, and vibration isolation means connecting said steering arm and said propulsion unit and located forwardly of said forwardly facing surface on said propulsion unit.

12. A marine propulsion device in accordance with claim 11 wherein said steering arm includes first and second walls extending in spaced relation to each other in the fore and aft direction, and wherein said vibration isolation means includes first and second non-resilient members respectively fixedly connected to said first and second walls and including respective first and second bores extending in the fore and aft direction, first and second resilient elements extending respectively in said first and second bores and respectively including first and second fore and aft bores, and first and second bolts extending respectively through said first and second bores in said resilient elements and fixedly connected to said propulsion unit.

13. An outboard motor in accordance with claim 12 wherein said first and second members respectively include first and second surfaces extending in spaced facing relation to each other in the fore and aft direction and respectively including therein first and second recesses which extend in the fore and aft direction, and a third resilient element located partially in said recesses.

14. An outboard motor in accordance with claim 13 wherein said third resilient element includes an aft surface in engagement with said propulsion unit and a forward surface in generally spaced parallel relation to said aft surface, and further including a thrust plate engaging said forward surface of said third resilient element and fixed to said first and second bolts.

15. An outboard motor in accordance with claim 14 wherein said thrust plate includes a central portion engaging said forward surface of said third resilient element and opposed first and second wing portions extending oppositely from said central portion and including respective first and second bores through which said first and second bolts extend.

16. An outboard motor in accordance with claim 15 and further including first and second sleeve members which respectively receive said bolts and engage said first and second bores in said first and second resilient elements.

17. An outboard motor comprising means adapted for connection to a boat transom and including a swivel bracket having a kingpin bore, a propulsion unit comprising a power head including an internal combustion engine, a lower unit fixed to said power head and including a drive shaft having a vertically extending axis, being driven by said engine, and adapted to drive a propeller, a forwardly facing surface located on said propulsion unit in forwardly spaced relation to said drive shaft axis, a kingpin/steering arm assembly including a kingpin extending in said kingpin bore, and a steering arm connected to said kingpin for rotation in common with said kingpin, a thrust plate supported by said kingpin/steering arm assembly, and a thrust block which is fabricated of resilient material, which is supported by said kingpin/steering arm assembly, which has a rearward surface engaging said forwardly facing surface, and which has a forward surface engaging said thrust plate.

18. A marine propulsion device in accordance with claim 17 wherein said forwardly facing surface includes first and second horizontally spaced thrust bores, wherein said steering arm includes first and second walls extending in spaced relation to each other in the fore and aft direction, and further including first and second non-resilient members respectively fixedly connected to said first and second walls and including respective first and second bores extending in the fore and aft direction, first and second resilient elements extending respectively in said first and second bores and respectively including first and second fore and aft bores, and first and second bolts extending respectively through said first and second bores in said first and second resilient elements and threadedly engaged with said first and second bores in said forwardly facing surface.

19. An outboard motor in accordance with claim 18 and further including first and second sleeve members which respectively receive said bolts and engage said first and second bores in said first and second resilient elements, wherein said first and second bolts includes respective first and second heads, wherein said thrust plate includes a central portion engaging said forwardly facing surface of said thrust block, and first and second wing portions which extend in opposite directions from said central portion and which include respective first and second bores receiving said first and second bolts and respectively located between said first and second bolt heads and said first and second sleeve members.

20. An outboard motor comprising means adapted for connection to a boat transom and including a swivel bracket having a kingpin bore, a propulsion unit comprising a power head including an internal combustion engine, and a lower unit fixed to said power head and including a shaft driven by said engine and adapted to support a propeller, and a housing enclosing said shaft and including a forwardly facing surface, a steering assembly including a kingpin extending in said kingpin bore, and a cavity extending fore and aft, and a resilient element extending in said cavity and including an aft end in engagement with said forwardly facing surface of said housing, and an outer peripheral endless surface extending in engagement with said steering assembly.

* * * * *